US009732751B2

(12) United States Patent
Takeda et al.

(10) Patent No.: US 9,732,751 B2
(45) Date of Patent: Aug. 15, 2017

(54) WATER LUBRICATED SCREW COMPRESSOR

(71) Applicant: Hitachi Industrial Equipment Systems Co., Ltd., Chiyoda-ku, Tokyo (JP)

(72) Inventors: Fumio Takeda, Tokyo (JP); Masayuki Kasahara, Tokyo (JP); Takehiro Matsuzaka, Tokyo (JP); Tsutomu Nozaki, Tokyo (JP); Hideharu Tanaka, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 450 days.

(21) Appl. No.: 14/199,750

(22) Filed: Mar. 6, 2014

(65) Prior Publication Data

US 2014/0308148 A1 Oct. 16, 2014

(30) Foreign Application Priority Data

Apr. 12, 2013 (JP) ..... 2013-083457

(51) Int. Cl.
*F04C 15/00* (2006.01)
*F04C 29/02* (2006.01)
(Continued)

(52) U.S. Cl.
CPC ..... *F04C 15/0092* (2013.01); *F04C 18/16* (2013.01); *F04C 29/021* (2013.01);
(Continued)

(58) Field of Classification Search
CPC ..... F04C 2210/128; F04C 2210/147; F04C 18/16; F04C 27/02; F04C 27/007;
(Continued)

(56) References Cited

U.S. PATENT DOCUMENTS 1,346,898 A * 7/1920 Kingsbury ..... G01F 23/243 137/392
8,616,856 B2 12/2013 Matsuzaka et al.
(Continued)

FOREIGN PATENT DOCUMENTS

BE WO 2005035989 A1 * 4/2005 ..... F04C 18/16
JP 2-286896 A 11/1990
(Continued)

OTHER PUBLICATIONS

Japanese Office Action issued in counterpart Japanese Application No. 2013-083457 dated Aug. 23, 2016 with English-language translation (five (5) pages).

*Primary Examiner* — Charles Freay
*Assistant Examiner* — Kenneth J Hansen
(74) *Attorney, Agent, or Firm* — Crowell & Moring LLP

(57) ABSTRACT

In a water-supply line for performing water-supply to the rotors and the mechanical seal of a compressor, or in a condensed-water collection line for collecting condensed water of a dryer into the inlet port of the compressor, a water reservoir is provided at a position higher than the water-supply unit of the compressor. Moreover, there are provided a start-time water-supply line and a solenoid valve set up therein. Here, the start-time water-supply line establishes the connection between the lower portion of the water reservoir, and the inlet port of the compressor and the water-supply unit of the mechanical seal.

5 Claims, 5 Drawing Sheets

(51) Int. Cl.
*F04C 18/16* (2006.01)
*F01C 21/08* (2006.01)

(52) U.S. Cl.
CPC ..... *F01C 21/08* (2013.01); *F04C 2210/147* (2013.01); *F05C 2253/20* (2013.01)

(58) Field of Classification Search
CPC .. F04C 15/0092; F04C 29/021; F01C 21/045; F05C 2253/20
USPC ..... 184/103.1; 418/84, 87, 97, 201.1, 270, 418/DIG. 1
See application file for complete search history.

(56) References Cited

U.S. PATENT DOCUMENTS

| | | | | |
|---|---|---|---|---|
| 2008/0260562 | A1* | 10/2008 | Van Der Heggen .... | F04C 18/16 418/142 |
| 2010/0233004 | A1* | 9/2010 | Matsuzaka ..... | F04B 39/06 418/84 |
| 2012/0164015 | A1* | 6/2012 | Yoshimura ..... | F01C 19/005 418/104 |

FOREIGN PATENT DOCUMENTS

| | | | |
|---|---|---|---|
| JP | 2000-45947 | A | 2/2000 |
| JP | 2004-36586 | A | 2/2004 |
| JP | 2010-209827 | A | 9/2010 |
| JP | 2011-149382 | A | 8/2011 |
| JP | 2012-57550 | A | 3/2012 |
| JP | 2012-233428 | A | 11/2012 |

* cited by examiner

WATER LUBRICATED SCREW COMPRESSOR

BACKGROUND OF THE INVENTION

The present invention relates to a water-lubricated screw compressor where the water-supply to resin rotors is made possible at the screw compressor's start time.

In a water-lubricated screw compressor, water is injected into a compression chamber that is formed of a casing and a single pair of male/female screw rotors. This feature allows the water-lubricated screw compressor to acquire clean air as an oil-free compressor, and to be superior in its cooling effect and seal effect as compared with those of conventionally-used dry screw compressors. As a result, the water-lubricated screw compressor is capable of implementing its low discharged-air temperature, small revolution number, and high performance.

On account of these characteristics, the water-lubricated screw compressor is expected to prevail in market from now on. The water injection into the compression chamber, however, requires that rust of the casing and rotors be prevented. High rust-resistant bronze is often used for the casing. Similarly, the high rust-resistant bronze is sometimes used for the rotors. In the bronze-formed rotors, however, the lubrication between the rotors is difficult to implement. Accordingly, non-contact driving between the rotors is implemented by setting up timing gears. Meanwhile, a resin, whose water lubrication is satisfying enough, is used for the rotors. This resin-used scheme makes it possible to implement directly contact driving between the rotors, thereby making it unnecessary to set up the timing gears.

The directly contact driving using these resin-formed rotors makes it possible to shorten the inter-rotors clearance, thereby allowing an enhancement in the compressor's performance. Also, setting up none of the timing gears also makes unnecessary an oil-lubricated mechanism of the timing gears. This condition simplifies the structure surrounding each bearing chamber.

Nevertheless, when these resin rotors are used, the following drawback exists: First, during the compressor's operation, the air pressure inside a water separator is present. Here, the water separator serves as a water tank as well. At this time, the air pressure inside the compression chamber of a water-supply unit of the compressor is lower than the air pressure inside the water separator. Accordingly, the water inside the water tank is supplied into the compression chamber by the pressure difference therebetween. At the compressor's start time, however, the air pressure inside the water separator absent. Consequently, no water is supplied into the compression chamber, until the air pressure inside the water separator becomes higher than the air pressure inside the compression chamber after the compressor's operation is started. As a result, at the worst, the resin rotors rotate in a state of remaining dried without the lubrication therebetween. Usually, it takes 5 to 10 seconds until the discharge pressure of the water-lubricated screw compressor rises up to its rated pressure, i.e., 0.7 MPa.

Also, when a roller bearing is used as the bearing of each of the rotors, and when the oil lubrication by the splash is implemented, a lip seal for sealing each rotor axis is used on the compression-chamber side of each bearing chamber of each rotor. This lip seal is used in order to prevent the oil from leaking from the bearing-chamber side onto the compression-chamber side. Moreover, a lip seal is used at the inlet-side end portion of the compression chamber of each rotor axis. This lip seal is used in order to prevent the water, which is injected into the compression chamber, from leaking from the compression-chamber side onto the bearing-chamber side. Furthermore, at the discharge-side end portion of the compression chamber, a mechanical seal is used. This mechanical seal is used, because the pressure difference is significant between the compression chamber and each bearing chamber. On account of this situation, during the compressor's operation, the water is also supplied to a slide part of the fixed member and rotational member of the mechanical seal in order to implement its lubrication and cooling. This water-supply is performed by the pressure difference between the water separator and the water-supply unit of the mechanical seal.

At the compressor's start time, however, the air pressure inside the water separator absent as is the case with the clearance between the resin rotors. Accordingly, the water-supply is not performed until the air pressure inside the water separator is caused to rise by the discharged air. This situation requires that a water-injecting method which is different from the water-supply from the water tank inside the water separator be provided at the compressor's start time. Here, of course, this method is required in order to perform the water-supply to the water-supply unit of each resin rotor and the slide part of the mechanical seal.

As a method for supplying the water to the water-supply unit of the water-lubricated screw compressor at the compressor's start time, for example, the following method is disclosed in JP-A-2000-45947: Namely, in this method, the water-supply is performed to the inter-resin-rotors clearance and the slide part of the mechanical-seal unit by using an external pressure-added water-supply line, and opening/closing a solenoid valve set up in this water-supply line.

SUMMARY OF THE INVENTION

FIG. 6 illustrates the method disclosed in JP-A-2000-45947 for performing the water-supply to the inter-rotors clearance and the slide part of the mechanical-seal unit by using the external pressure-added water-supply line. The external pressure-added water-supply line 32 extends via the first solenoid valve 29. Moreover, across this valve 29, the water-supply line 32 branches into two directions. One branch line is connected to an inlet-port water-supply line 12 for supplying the water to the inter-rotors clearance from the aperture portion of an inlet port. The other branch line is connected to a second mechanical-seal water-supply line 11*b*, which is a line for supplying the water to the slide part of the mechanical seal. Pushing the start button of the compressor results in the following operations: Namely, the first solenoid valve 29 set up in the external pressure-added water-supply line 32 is opened for a certain constant time (e.g., 3 seconds), thereby performing the water-supply. Then, the first solenoid valve 29 is closed after the start, thereby stopping the water-supply. In this case, the water is supplied from the external pressure-added water-supply line 32 on each start basis. As a result of this condition, there has existed the following problem: Namely, the water-supply from the outside (e.g., tap water) at the compressor's start time brings about the consumption of a large amount of water over the entire use time-period of the water-lubricated screw compressor.

Also, when the tap water is used as the external pressure-added water-supply line 32, the tap water adhering to the water-supply unit is dried. Moreover, ions such as calcium and magnesium melted within the tap water are precipitated, thereby producing solid substances. Then, if these solid substances precipitated are engaged into the inter-rotors clearance and the slide part of the mechanical seal, there has existed the following problem: Namely, these solid substances become a cause for the damage and wear-out of each rotor and the slide part. Furthermore, if these solid substances flows through a water-supply line 16 together with circulation water, these solid substances adhere to a water filter 20 set up in the water-supply line. This adherence gives rise to the occurrence of clog of the water filter 20. As a result, there has existed a problem that the exchange frequency of the water filter increases.

Furthermore, if the water-supply amount at the compressor's start time is too much, the water filled in each rotor gives rise to the occurrence of liquid compression. As a result, there has existed a problem that the start itself becomes impossible.

The present invention has been devised in order to solve the above described problems. Namely, an object of the present invention is as follows: Saving of the water-supply amount from the outside, prevention of the damage and wear-out of each rotor and the mechanical seal due to the engagement of the solid substances produced by the precipitation of the ions such as calcium and magnesium contained in the tap water, and prevention of start's impossibility caused by the liquid compression due to the too much water-supply amount.

In order to solve the above described problems, in the present invention, in a water-supply line, a water reservoir is provided at a position higher than the water-supply position of a compressor. Moreover, a water-reservoir entrance line and a water-reservoir exit line of the water-supply line are deployed at the upper portion of the water reservoir. Simultaneously, a start-time water-supply line is provided at the lower portion of the water reservoir. Here, the start-time water-supply line is connected to the inlet port of the compressor and the water-supply unit of a mechanical seal, and has a solenoid valve.

Also, in a condensed-water collection line of a dryer provided in a discharge line, a water reservoir is provided at a position higher than the water-supply position of a compressor. Moreover, a water-reservoir entrance line and a water-reservoir exit line of the condensed-water collection line are deployed at the upper portion of the water reservoir. Simultaneously, a start-time water-supply line is provided at the lower portion of the water reservoir. Here, the start-time water-supply line is connected to the inlet port of the compressor and the water-supply unit of a mechanical seal, and has a solenoid valve. Furthermore, an entrance line and an exit line into/from the water reservoir are provided on the upper-portion side surface of the water reservoir. Also, there is provided a control device for causing the solenoid valve to perform an open/close operation based on a set time, the solenoid valve being provided in the start-time water-supply line.

According to a start-time water-supply method of the present invention for performing the water-supply to the inter-rotors clearance and the slide part of the mechanical seal, the water circulating in the inside of the compressor is retained in advance, and is supplied at the compressor's start time. As a result, it is unnecessary to perform the water-supply from the outside every time the compressor is started. This feature makes it possible to reduce the consumption amount of the tap water.

Also, the water supplied in the water-supply is the circulation water inside the water separator and the condensed water of the dryer. This feature makes it possible to prevent the damage and wear-out of the engagement portion of each rotor and the slide part of the mechanical seal, and the occurrence of the clog of the water filter in a short time-period. Here, the above-described damage and wear-out are caused to occur by the engagement of the precipitated substances of the ions such as calcium and magnesium contained in the tap water supplied from the outside. Moreover, the water-supply amount at the compressor's start time can be controlled. This feature results in an advantage of being capable of avoiding the start's impossibility caused by a torque increase due to the too much water-supply at the compressor's start time, and the water-supply's lack due to a viscosity increase.

Other objects, features and advantages of the invention will become apparent from the following description of the embodiments of the invention taken in conjunction with the accompanying drawings.

DETAILED DESCRIPTION OF THE EMBODIMENT

Figure 5:
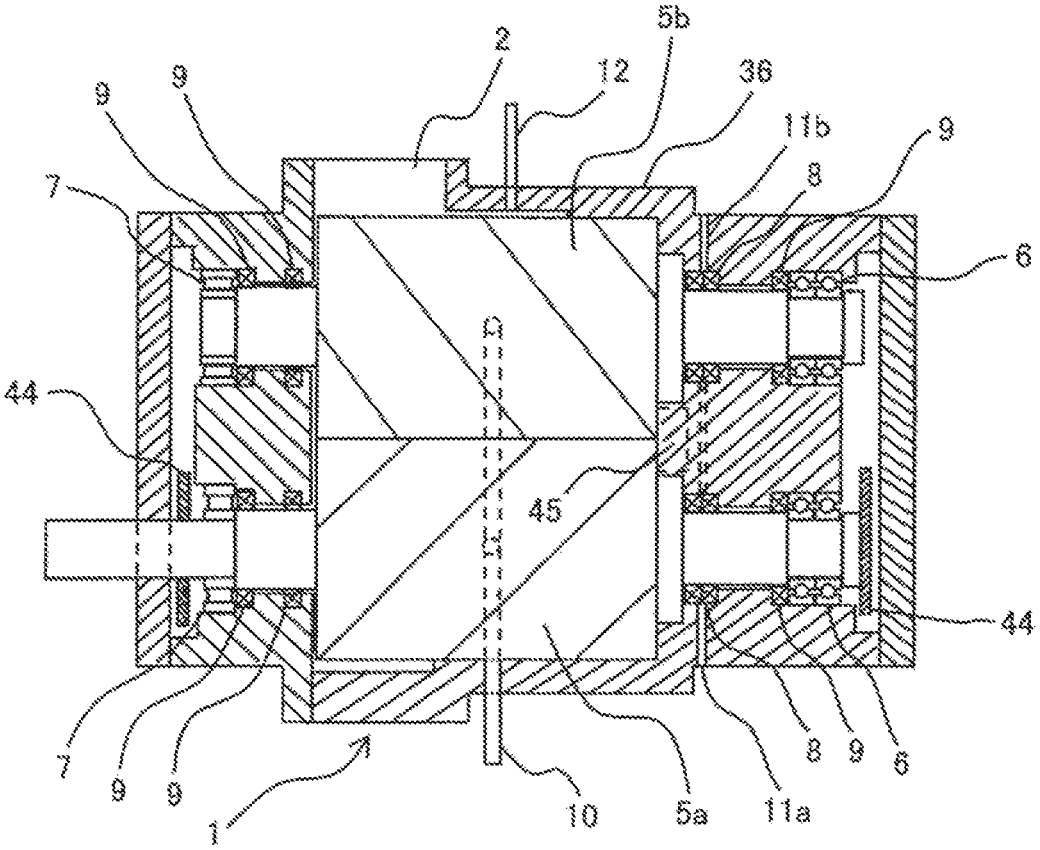
FIG. 5 is a horizontal direction's cross-sectional diagram for illustrating the structure of the water-lubricated screw compressor.

Hereinafter, the explanation will be given below concerning a first embodiment of the present invention. FIG. 5 illustrates the structure of the water-lubricated screw compressor. In the water-lubricated screw compressor 1, a single pair of male rotor 5*a* and female rotor 5*b* are supported by cylindrical roller bearings 7 at the inlet-side axis end portion, and are supported by duplex angular bearings 6 at the discharge-side axis end portion. Moreover, the male rotor 5*a* and the female rotor 5*b* are contained inside a casing 36 in a state of being engaged with each other. The lubrication of these bearings is implemented as follows: Namely, the oil filled in each of oil reservoirs provided on the inlet side and the discharge side is splashed over the bearing clearances by the rotation of splash parts 44 provided near these bearings. Furthermore, an inlet port 2 and a discharge port 45 are provided on the casing 36. Air made inlet from the inlet port 2 is filled into a compression chamber that is formed of the male rotor 5*a* and the female rotor 5*b*. Then, this air is compressed in such a manner that the inner volume of the compression chamber is decreased in accompaniment with the rotation of these male and female rotors. After that, the compression chamber displaces in a direction of the discharge-side end surface, thereby being apertured into a discharge chamber. This operation causes the air inside the compression chamber to be discharged onto the discharge port 45.

In this compression process, the compression chamber displaces, and then reaches a water-supply position provided in the casing 36. At this time, water supplied from a rotor injection line 10 is injected into the compression chamber from a water-injecting hole provided at the water-supply position. After that, the air and the water are compressed together, then being discharged together from the discharge port 45. Lip seals 9 are provided on the rotor side of the bearings 7 provided on the inlet-side axis of each rotor. The lip seals 9 prevent the oil of each bearing chamber from mixing onto the rotor side. Also, lip seals 9 are provided on the inlet end-surface side of each rotor. The lip seals are provided in order to prevent the water, which is injected onto each rotor, from leaking into each bearing chamber and mixing into the lubrication oil. The inlet port 2 is formed at the inlet-side end portion of each rotor. Since the pressure does not become higher, the sealing of each rotor axis based on each lip seal 9 is implementable.

Similarly, lip seals 9 are provided on the rotor side of the bearings 6 provided on the discharge-side axis of each rotor. The lip seals 9 prevent the oil of each bearing chamber from mixing onto the rotor side. Also, mechanical seals 8 are provided on the discharge end-surface side of each rotor. The mechanical seals are provided in order to prevent the water, which is injected onto each rotor, from leaking into each bearing chamber together with the compressed air. The gas pressure close to the discharge pressure is applied onto the discharge end-surface side of each rotor. As a result, there is a possibility that the lip used in each lip seal is damaged by the gas pressure. Meanwhile, the sealing based on each mechanical seal 8 is implemented as follows: Namely, its fixed member fixed to the housing and its rotational member mounted onto the axis and rotating therewith perform a sliding movement with each other on the seal surface of each mechanical seal 8. On account of this sliding movement, the seal surface of each mechanical seal 8 is lubricated by the water-supply from a first mechanical-seal water-supply line 11*a* during the compressor's operation. The inlet-port water-supply line 12 apertured into the inlet port 2 is a line for supplying the water to the inter-rotors clearance at the compressor's start time. Similarly, the second mechanical-seal water-supply line 11*b* is a line for supplying the water to the slide part of each mechanical seal at the compressor's start time.

Figure 6:
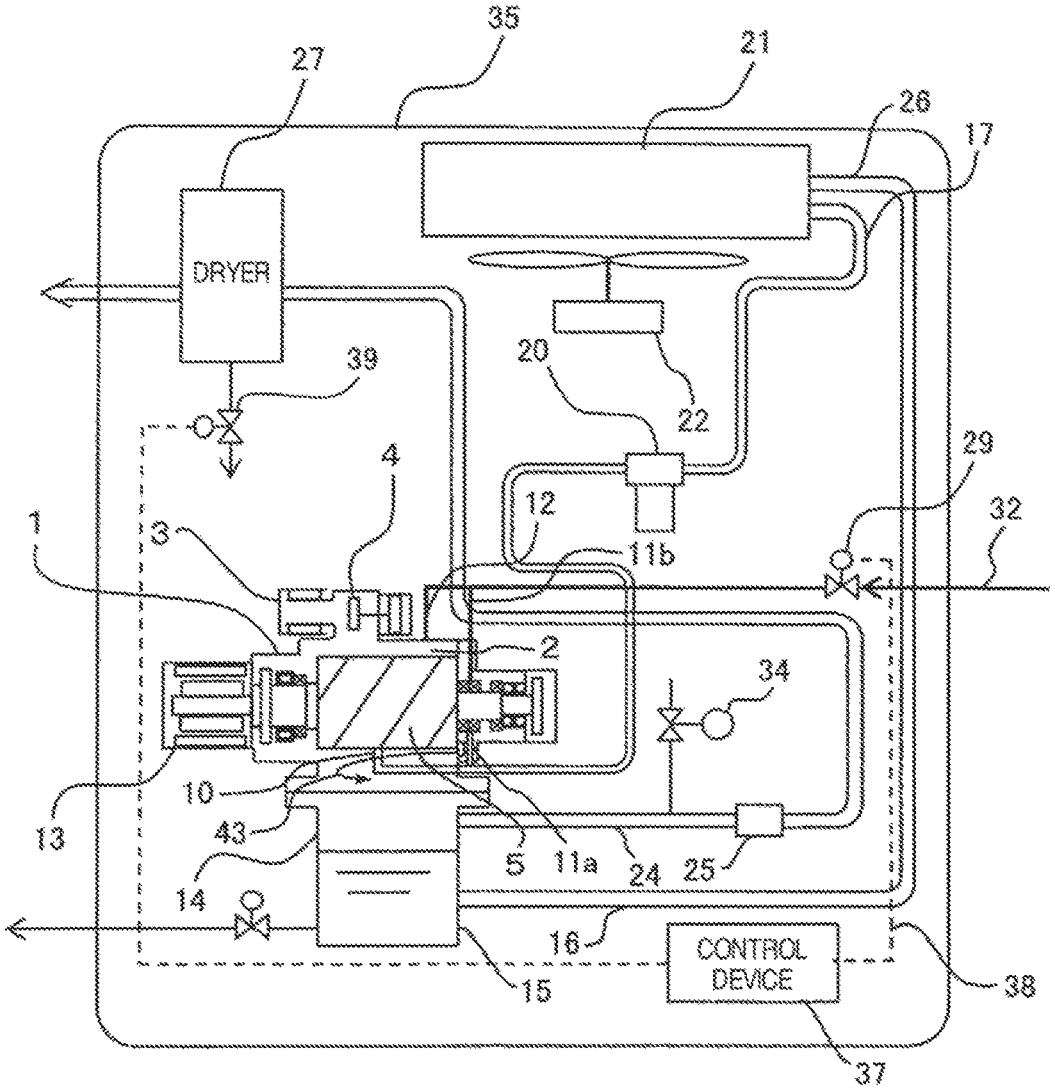
FIG. 6 is the unit line system diagram for illustrating the conventional water-supply system.

Next, referring to FIG. 6, the explanation will be given below concerning the related-art method of performing the water-supply to the inter-rotors clearance and the slide part of the mechanical-seal unit at the compressor's start time. The water-lubricated screw compressor 1 is driven by a driving motor 13 that is directly connected to the axis end of the male rotor. The air in the atmosphere is made inlet from the inlet port 2 that is equipped with an inlet filter 3 and an inlet unloader 4. Then, the air is compressed inside the compression chamber formed of the inter-rotors groove. Next, the air compressed is discharged from the discharge port together with the water that is injected from the rotor injection line 10 on its way to this discharge. Moreover, the air and water discharged flow into a water separator 14 while being turned around in a discharge stream line 43, thereby being separated into the air and the water independently. Here, the water separator 14 is provided at the lower portion of the water-lubricated screw compressor 1. Then, the water is retained into a water tank 15 that is provided at the lower portion of the inside of the water separator 14. Furthermore, during the compressor's operation, the water retained into the water tank 15 is caused to pass through a water-supply line 16 by the pressure inside the water separator 14. Then, the water is cooled down to a temperature lower than an allowable temperature by a cooling fan 22 in a water cooler 21 deployed at the upper portion of the compressor unit 35. After that, the mixed substances within the water are filtered by being caused to pass through the water filter 20. After that, the water is supplied into the compression chamber of the compressor from the rotor injection line 10. The rotor injection line 10 branches halfway, thereby being connected to a first mechanical-seal water-supply line 11*a*. The water-supply to the slide part of the mechanical-seal unit is performed from this first mechanical-seal water-supply line 11*a*.

Meanwhile, the compressed air is discharged from a discharge line 24 provided at the upper portion of the water separator 14. The compressed air is discharged, when its pressure is caused to exceed a set pressure by a regulating check valve 25. The portion of the discharge line 24 across this valve 25 is connected to a dryer 27. In this dryer 27, the compressed air is cooled down, and the mist-like moisture contained within the air is condensed down to the saturated vapor pressure at its dew-point temperature. Moreover, the compressed air dried is discharged from a compressed-air supply line. The condensed water produced by the moisture condensation inside the dryer 27 is retained into a dryer's tank. Furthermore, the condensed water retained into the dryer's tank is drained periodically from a drain line provided on the dryer's tank. This periodical drain operation is performed by the open/close operation of a solenoid valve 39 provided in the drain line.

Here, the explanation will be given below concerning the prior-art method of performing the water-supply to the inter-rotors clearance and the slide part of the mechanical-seal unit at the compressor's start time. Usually, it is conceivable to use the tap-water line. The external pressure-added water-supply line 32 is provided for implementing the tap-water replenishment for the water tank 15. Via the first solenoid valve 29, the water-supply line 32 is connected to the inlet-port water-supply line 12 for supplying the water to the inter-rotors clearance, and the second mechanical-seal water-supply line 11*b* for supplying the water to the slide part of the mechanical seal. Here, the water-supply line 12 is connected to the inlet port 2 of the water-lubricated screw compressor 1.

At the compressor's start time, the first solenoid valve 29 is opened, thereby starting the water-supply to the inter-rotors clearance and the slide part of the mechanical seal. Then, after the lapse of a certain constant time, the first solenoid valve 29 is closed, thereby stopping the water-supply thereto. After that, the water-lubricated screw compressor 1 is started.

Consequently, according to the present prior-art method, the water-supply from the outside is performed on each start basis. As a result of this condition, the water's consumption amount increases when the tap water is used. Also, the ions such as calcium and magnesium are contained in the tap water, and are precipitated on the water-supply unit. Then, if the substances precipitated are engaged into the engagement portion of the rotors and the slide part of the mechanical seal, these precipitated substances become a cause for their damage and wear-out in some cases.

Furthermore, if the water-supply amount is too much, the liquid compression is caused to occur at the compressor's start time. As a result, the start itself becomes impossible in some cases.

Figure 1:
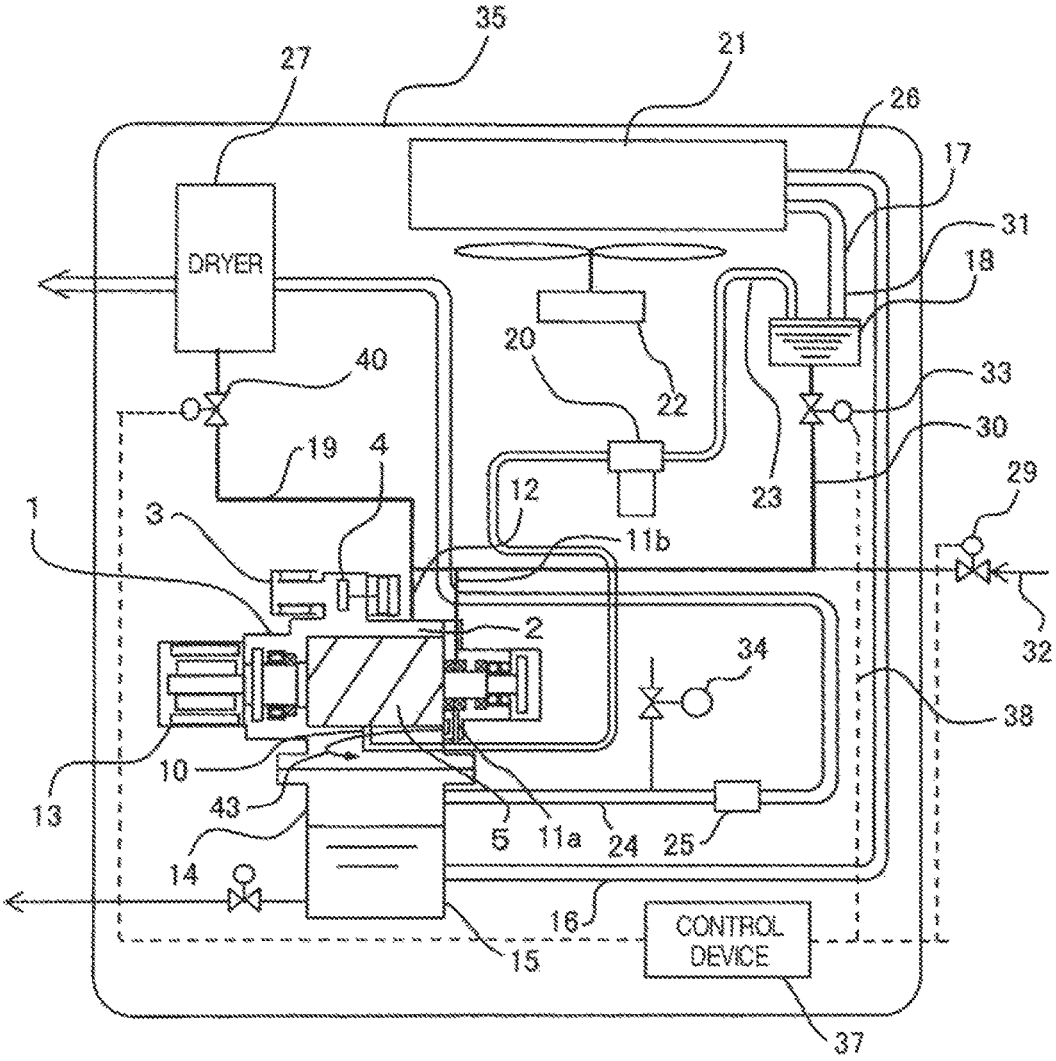
FIG. 1 is a unit line system diagram for illustrating a first embodiment of the present invention.

Next, referring to FIG. 1, the detailed explanation will be given below concerning the first embodiment of the present invention. The water is retained into the water tank 15 that is provided at the lower portion of the water separator 14 of the water-lubricated screw compressor 1. During the compressor's operation, this water is caused to pass through the water-supply line 16 by the pressure inside the water separator 14. Then, this water is cooled down to a temperature lower than the allowable temperature by the water cooler 21 provided at the upper portion of the compressor unit 35. Here, a water reservoir 18 is provided at a position higher than the water-supply unit of the water-lubricated screw compressor 1. Accordingly, after the above-described cool down, the water flows into the water reservoir 18 to fill the water reservoir 18 from a water-reservoir entrance line 31 that is deployed across a water-cooler exit line 17 connected to the upper portion of the water reservoir 18. Moreover, a water-reservoir exit line 23 is connected to the upper portion of the water reservoir 18. Consequently, the water that overflows the water reservoir 18 enters and passes through the water-reservoir exit line 23. Furthermore, the mixed substances within the water are filtered by the water filter 20. After that, the water is supplied into the inter-rotors clearance from the rotor injection line 10 of the water-lubricated screw compressor 1.

Also, the rotor injection line 10 branches halfway, thereby being connected to the first mechanical-seal water-supply line 11*a*. This first mechanical-seal water-supply line 11*a* performs the water-supply to the slide part of the mechanical-seal unit. The water supplied into the inter-rotors clearance is discharged from the discharge port together with the compressed air. Moreover, the water is separated from the compressed air inside the water separator 14 by the turning-around discharge stream line 43. Then, the water separated is reserved into the water tank 15 that is provided at the lower portion of the inside of the water separator 14. Meanwhile, the compressed air separated from the water is discharged from the discharge line 24 that is connected to the upper portion of the water separator 14. The compressed air is discharged, when its pressure is caused to exceed the set pressure by the regulating check valve 25. Usually, the set pressure is set at 0.5 MPa. The compressed air discharged passes through the dryer 27 across this valve 25. In this dryer 27, the mist-like moisture contained within the discharged air is condensed down to its dew-point temperature. Moreover, the compressed air whose humidity is removed is discharged into the discharge line. A condensed-water collection line 19 is provided onto the condensed-water tank of the dryer 27. The condensed-water collection line 19 is connected to the inlet port 2 of the water-lubricated screw compressor 1 via a fourth solenoid valve 40. The fourth solenoid valve 40 is periodically opened/closed in accordance with a signal from a control device 37. This operation causes the condensed water of the dryer 27 to be pulled and absorbed into the inlet port 2 whose pressure is lower than the atmospheric pressure. Furthermore, the condensed water pulled and absorbed into the inlet port 2 is charged into the compression chamber of the compressor. After that, the condensed water is discharged from the discharge port into the water separator 14, then circulating around the compressor.

A start-time water-supply line 30 is connected to the lower portion of the water reservoir 18. A second solenoid valve 33, which is deployed behind the start-time water-supply line 30, is opened at the compressor's start time. As a result, the water that has been charged into the water reservoir 18 during the compressor's operation is supplied by the potential energy. Here, this water is supplied from the inlet-port water-supply line 12 and the second mechanical-seal water-supply line 11*b*, which are deployed across the water reservoir 18, to the inter-rotors clearance and the slide part of the mechanical-seal unit, respectively.

Usually, the water-supply amount needed at the compressor's start time is equal to about 5 liters/minute from the test result. The time that has elapsed until the pressure inside the water separator is raised and the water-supply is started by the raised pressure is equal to 5 to 10 seconds. Accordingly, about 1 or more litter is sufficient enough as the inner volume of the water reservoir 18 for obtaining the water-supply time needed at the compressor's start time. Also, assuming that the elevation difference between the water reservoir 18 and the water-supply unit of the water-lubricated screw compressor 1 is equal to 1 m, about 5 mm is sufficient enough as the inner diameter of the water-supply line at the compressor's start time. Also, the external pressure-added water-supply line 32 for implementing the water replenishment when the water inside the water tank 15 is lacking is provided in the compressor unit 35. This water-supply line 32 is connected to the inlet port 2 via the first solenoid valve 29.

If the water level of the water tank 15 of the water separator 14 becomes lower than a reference range during the compressor's operation, the first solenoid valve 29 is opened by the control device 37. This operation causes the water of the external pressure-added water-supply line 32 (i.e., tap-water line) to be made inlet from the inlet port 2 of the compressor, and to be charged into the water tank 15 of the water separator 14 eventually.

According to the present invention, the water is charged into the water reservoir 18 during the compressor's operation. Moreover, the water is maintained at the compressor's stop time as well. These features allow the water inside the water reservoir 18 to be supplied at the compressor's start time to the inter-rotors clearance and the slide part of the mechanical-seal unit of the compressor.

Accordingly, it is unnecessary to perform the water-supply from the external pressure-added water-supply line 32 (i.e., tap-water line) every time the compressor is started. This feature makes it possible to save the water's consumption. Also, the water inside the water tank 15 is supplied. This feature brings about none of the increase in the ions such as calcium and magnesium like the case where the tap water is used. This condition, further, gives rise to none of the occurrence of the damage and wear-out of the inter-rotors clearance and the slide part of the mechanical-seal unit, which are caused to occur in such a manner that the precipitated substances of the ions are produced on the water-supply unit, and are engaged into the inter-rotors clearance and the slide part.

Moreover, the water supply from the water reservoir 18 is performed based on the potential energy. This feature gives rise to none of the occurrence of the in-rotors liquid compression due to the too much water supply, as long as the diameter of the water-supply line is properly set in advance. As a result, there occurs none of the start impossibility. Also, the water reservoir 18 is provided at the position higher than the water-supply unit of the water-lubricated screw compressor 1. This feature allows the water inside the water reservoir 18 to be supplied at the compressor's start time to the inter-rotors clearance and the slide part of the mechanical-seal unit. As a result, the water cooler as illustrated in FIG. 1 is not required to be provided at the upper portion of the compressor unit. This feature allows implementation of an increase in the degree-of-freedom of layout.

Also, the start-time water-supply line 30 connected to the water reservoir 18 is provided separately from the water-reservoir exit line 23, i.e., the water-supply line that functions during the compressor's operation. As a result, by closing the second solenoid valve 33 after the compressor's start, the water heated during the compressor's operation is prevented from being made inlet into the water-lubricated screw compressor from the inlet port. Accordingly, there occurs none of a lowering in the performance of the compressor. Incidentally, if the water whose temperature is higher than that of the inlet air is supplied into the compressor during the compressor's operation, the compressor is heated at this inlet time, and its air density decreases. Consequently, a tendency is observed that its performance becomes lowered.

Figure 2:
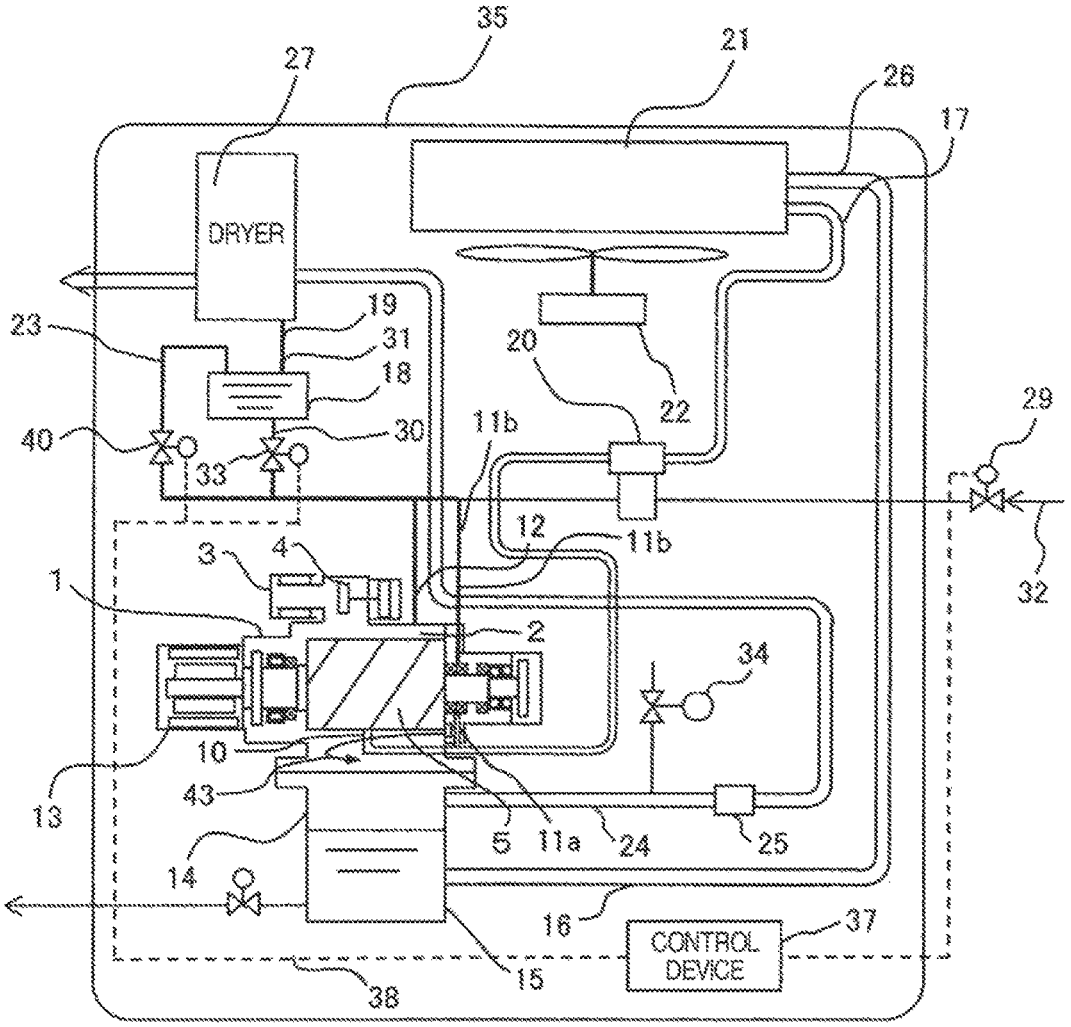
FIG. 2 is a unit line system diagram for illustrating a second embodiment of the present invention.

Next, referring to FIG. 2, the explanation will be given below concerning a second embodiment of the present invention. In FIG. 2, the water-supply and water-discharge lines of the compressor unit 35 are the same as those of the first embodiment illustrated in FIG. 1. The feature of the second embodiment illustrated in FIG. 2 is as follows: Namely, the water reservoir 18, from which the water-supply is performed at the compressor's start time, is provided in the condensed-water collection line 19 of the dryer 27 that is provided in the discharge line. The condensed-water collection line 19, which is connected to the condensed-water tank of the dryer 27, is connected to the upper surface of the water reservoir 18 in its front end as the water-reservoir entrance line 31. Here, the water reservoir 18 is provided at the position higher than the water-supply unit of the compressor. Meanwhile, the water-reservoir exit line 23, which is mounted onto the upper surface of the water reservoir 18, is connected to the inlet-port water-supply line 12 via the fourth solenoid valve 40. Here, the water-supply line 12 is connected to the inlet port 2 of the compressor. The inlet-port water-supply line 12 branches before the junction portion of the inlet port 2, thereby being connected to the second mechanical-seal water-supply line 11*b* as well. Also, the start-time water-supply line 30, which is connected to the inlet-port water-supply line 12 via the second solenoid valve 33, is provided at the lower portion of the water reservoir 18.

The second solenoid valve 33 of the start-time water-supply line 30 and the fourth solenoid valve 40 of the water-reservoir exit line 23 are closed during the compressor's operation. As a result, the condensed water produced by the condensation inside the dryer 27 is reserved into the water reservoir 18. Then, the fourth solenoid valve 40 of the water-reservoir exit line 23 is opened with a timing with which the liquid surface of the condensed water reaches the upper surface of the water reservoir 18. This operation causes the condensed water to be collected into the inlet port 2 of the compressor.

Also, the fourth solenoid valve 40 of the water-reservoir exit line 23 is closed with the timing with which the condensed water that has overflowed the water reservoir 18 is collected. This operation makes it possible to prevent the leakage of the discharged air. Moreover, when the compressor is stopped, the inside of the water reservoir 18 is filled with the condensed water. Then, the second solenoid valve 33 of the start-time water-supply line 30 is opened at the compressor's start time. Since the water reservoir 18 is filled with the condensed water, this operation causes the condensed water inside the water reservoir 18 to be supplied into the inlet port 2 of the compressor via the inlet-port water-supply line 12, and to be supplied into the slide part of the mechanical seal via the second mechanical-seal water-supply line 11*b*.

After the compressor's start, the second solenoid valve 33 of the start-time water-supply line 30 is closed. This operation allows implementation of the normal condensed-water collection operation performed by the dryer 27.

According to the present invention, no water is supplied from the external pressure-added water-supply line 32 every time the compressor is started. This feature makes it possible to implement the water's saving. Also, the utilization of the condensed water allows prevention of the precipitation of the ions such as calcium and magnesium. This feature makes it possible to prevent the occurrence of the damage and wear-out of the inter-rotors clearance and the slide part of the mechanical-seal unit. Also, there occurs none of the occurrence of the in-rotors liquid compression due to the too much water supply. This feature makes it possible to prevent the occurrence of the start impossibility, as is the case with the first embodiment.

Figure 3:
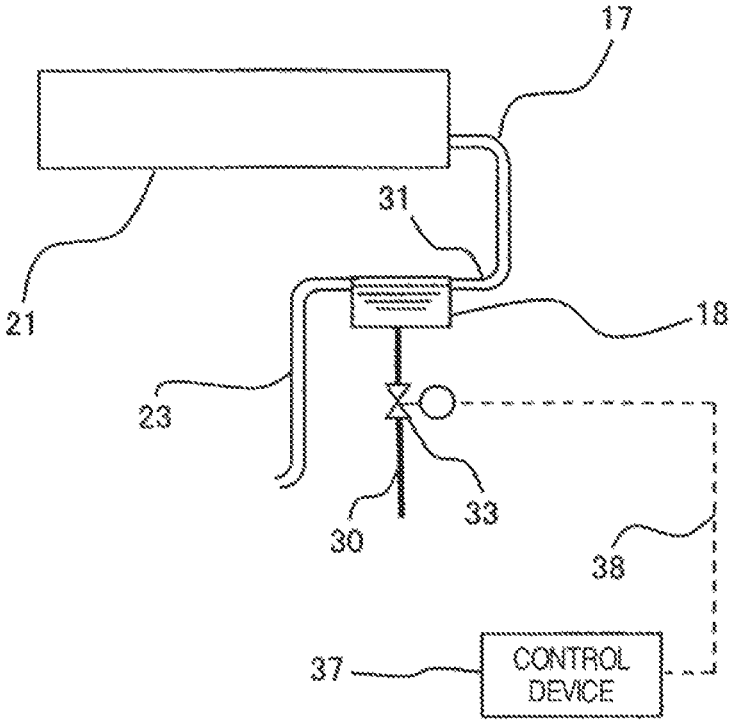
FIG. 3 is a line diagram of the water reservoir, which illustrates a third embodiment of the present invention.

Next, referring to FIG. 3, the explanation will be given below concerning a third embodiment of the present invention. FIG. 3 illustrates another overflow structure for filling the water reservoir 18 with the water. The water-reservoir entrance line 31 and the water-reservoir exit line 23, which are deployed across the water-cooler exit line 17, i.e., the entrance line into the water reservoir 18, are connected to the side-surface upper portion of the water reservoir 18. The water, which flows into the water reservoir 18 from the water-reservoir entrance line 31, fills the water reservoir 18. Accordingly, the water's surface reaches the position of the water-reservoir exit line 23. Subsequently, water, whose amount is larger than the amount of the water that has flown into the water reservoir 18, flows out of the water-reservoir exit line 23. Consequently, it turns out that, at the point-in-time when the compressor is stopped, the water always fills the water reservoir 18 up to the upper surface thereof. This condition allows implementation of the water supply at the compressor's start time.

Figure 4:
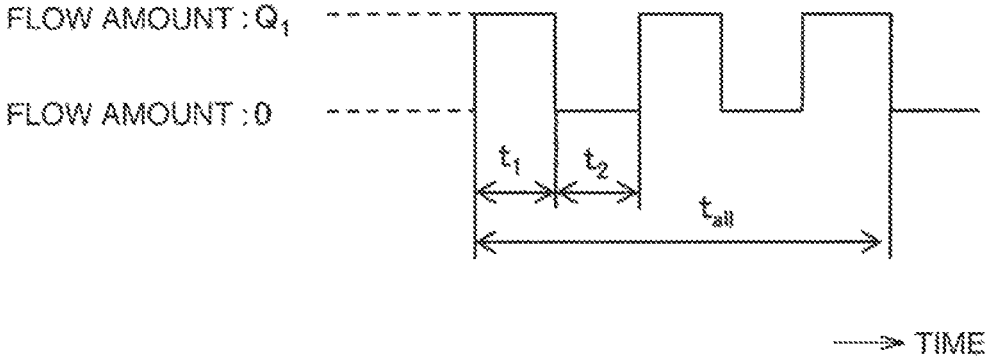
FIG. 4 is a flow pattern diagram for illustrating an adjustment method of adjusting the water-supply amount, which illustrates a fourth embodiment of the present invention.

Next, referring to FIG. 4, the explanation will be given below concerning a fourth embodiment of the present invention. FIG. 4 illustrates a control method of controlling the water-supply amount from the water reservoir 18. If the viscosity of the water changes depending on the start conditions or temperature, the open/close of the solenoid valve is repeated with a certain constant time-interval associated therewith without continuing to open the valve during the entire compressor's start time. This method makes it possible to control the water-supply amount. In this case, the water-supply amount becomes lowered as compared with the case where the valve is opened during the entire compressor's start time $t_{all}$. In view of this situation, the diameter of the water-supply line is beforehand set at, e.g., a dimension which allows acquisition of the maximum flow amount. Then, the water-supply amount is set and given based on the ratio between the open time $t_1$ and the close time $t_2$ of the solenoid valve.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A water-lubricated screw compressor, comprising:

a single pair of male/female resin screw rotors, both ends of said resin screw rotors being supported by bearings, a clearance between a discharge-side end surface of each of said resin screw rotors and a discharge-side bearing chamber being sealed by a mechanical seal, said resin screw rotors being contained inside a casing equipped with an inlet port and a discharge port;

a water-supply line for supplying water into a compression chamber of said screw compressor and a slide part of each said mechanical seal, said water being retained in a water tank inside a water separator; and a discharge stream line for establishing connection between said discharge port and said water separator; wherein said water-lubricated screw compressor further comprises:

a water reservoir provided at a position of said water-supply line higher than a water-supply position of said screw compressor;

an entrance line into the water reservoir and an exit line out of the water reservoir extending from an upper surface of an upper portion of said water reservoir;

a start-time water-supply line provided at lower portion of said water reservoir, said the start-time water-supply line being connected to said inlet port of said casing and a water-supply of said mechanical seals; and a solenoid valve provided between said water reservoir and said start-time water-supply line.

2. The water-lubricated screw compressor according to claim 1, wherein said entrance line and said exit line extend from side surfaces of said upper portion of said water reservoir.

3. The water-lubricated screw compressor according to claim 1, wherein a water-supply amount of said water at a start time is made controllable by setting a line diameter of said start-time water-supply line at a value which allows acquisition of a maximum flow amount of said water, and causing said solenoid valve of said start-time water-supply line to perform at least one of an ON/OFF operation and an open/close operation in accordance with a time set by a control device.

4. A water-lubricated screw compressor, comprising:

a screw chamber containing a screw rotor for providing compressed air;

a water separator separating water from the compressed air;

a water tank containing the separated water, and supplying the separated water using a difference in pressure between the water tank and the screw chamber; and a water reservoir located between the water tank and the screw chamber and containing the separated water supplied from the water tank;

an entrance line supplying water to the water reservoir; and an exit line supplying water from the water reservoir to the screw chamber; wherein the water reservoir supplies the water to the screw compressor using a difference in height between the water reservoir and the screw chamber when the difference in pressure is insufficient to supply water from the water tank to the screw chamber; and the entrance line and the exit line extend from an upper surface of the water reservoir or from an upper portion of a side surface of the water reservoir.

5. The water-lubricated screw compressor according to claim 4, further comprising:

a second exit line used to supply the water to the screw chamber when the pressure is insufficient to supply the water from the water tank to the screw chamber; wherein the second exit line extends from a bottom surface of the water reservoir or from a lower portion of the side surface.

* * * * *